US008475304B2

(12) United States Patent
Ou

(10) Patent No.: US 8,475,304 B2
(45) Date of Patent: Jul. 2, 2013

(54) STITCHINGLESS BASEBALL, SOFTBALL OR THE LIKE AND MANUFACTURING METHOD THEREOF

(76) Inventor: Tsung Ming Ou, Kaohsiung (TW)

( * ) Notice: Subject to any disclaimer, the term of this patent is extended or adjusted under 35 U.S.C. 154(b) by 73 days.

(21) Appl. No.: 12/807,992

(22) Filed: Sep. 16, 2010

(65) Prior Publication Data

US 2012/0071283 A1 Mar. 22, 2012

(51) Int. Cl.
*A63B 37/12* (2006.01)

(52) U.S. Cl.
USPC ..... 473/598; 473/597

(58) Field of Classification Search
USPC ..... 473/600–602, 596, 597, 598, 599
See application file for complete search history.

(56) References Cited

U.S. PATENT DOCUMENTS

| | | | | | |
|---|---|---|---|---|---|
| 1,502,784 | A * | 7/1924 | Kennedy | 473/598 |
| 1,861,157 | A * | 5/1932 | Grady | 473/598 |
| 1,980,472 | A * | 11/1934 | Clarke | 473/598 |
| 2,093,737 | A * | 9/1937 | Reach | 473/602 |
| 2,214,179 | A * | 9/1940 | Reach | 156/147 |
| 2,325,128 | A * | 7/1943 | Grady | 473/597 |
| 2,645,487 | A * | 7/1953 | Hawes | 473/601 |
| 3,069,170 | A * | 12/1962 | Dillon, Jr. | 473/280 |
| 3,256,019 | A * | 6/1966 | Barton | 473/597 |
| 4,498,667 | A * | 2/1985 | Tomar | 473/600 |
| 4,729,566 | A * | 3/1988 | Molitor | 473/600 |
| 4,840,378 | A * | 6/1989 | Molitor | 473/600 |
| 5,588,648 | A * | 12/1996 | Stebbins | 473/451 |
| 5,664,774 | A * | 9/1997 | Walker et al. | 473/600 |
| 6,302,815 | B1 * | 10/2001 | Shishido et al. | 473/604 |
| 6,458,052 | B1 * | 10/2002 | Pitsenberger et al. | 473/598 |
| 6,475,119 | B2 * | 11/2002 | Chow | 482/49 |
| 6,592,477 | B1 * | 7/2003 | Yang | 473/597 |
| 2005/0176533 | A1 * | 8/2005 | Chan | 473/600 |

* cited by examiner

*Primary Examiner* — Steven Wong
(74) *Attorney, Agent, or Firm* — Raymond Y. Chan; David and Raymond Patent Firm

(57) ABSTRACT

A baseball, softball or the like includes a ball core and a plurality of carcass panels attaching on the outer surface of the ball core. Each of the carcass panels, which is cut into a predetermined shape, has a main portion and an edge portion formed along a peripheral edge of the main portion, wherein each of the carcass panels is attached on the outer surface of the ball core without stitching with other the carcass panels at a position that the carcass panels are attached in an edge-to-edge manner, such that the carcass panels form an outer shell at the ball core in a thread-less manner.

3 Claims, 9 Drawing Sheets

20
231
23
10
16

21
20
231
23

20
10
23
231

20
231
23

20
21
22
23
231
21
20

20
231
23
10
16

21
20
23
231

20
10
23
231

20
231
23
20

231
21
23
20
21
22
20

STITCHINGLESS BASEBALL, SOFTBALL OR THE LIKE AND MANUFACTURING METHOD THEREOF

BACKGROUND OF THE PRESENT INVENTION

1. Field of Invention

The present invention relates to non-inflatable sportsball, and more particularly to a baseball, softball or the like, and a manufacturing method thereof, wherein the baseball, softball or the like has a plurality of carcass panels attached on a ball core without stitching.

2. Description of Related Arts

A conventional baseball, softball or the like, usually comprises a ball core inflated to have a spherical shape, a plurality of carcass panels, and a cushion layer attached underneath inner surfaces of the carcass panels. The carcass panels and the cushion layer are overlapped on the outer surface of the ball core so as to constitute the outermost layer of the baseball, softball or the like. Since baseballs or softballs are subject to great impact, each of the carcass panels has a peripheral edge portion sewn or stitched with the peripheral edge portion of an adjacent carcass panel, generally 108 double stitches, in order prevent detachment of the carcass panels from the ball core or the cushion layer.

The conventional method of manufacturing a baseball, softball or the like, involves hand stitching of each of the carcass panels onto the ball core and with adjacent carcass panels. As a result, each of the carcass panel has the peripheral edge portion which is slanted with respective to a main portion of the carcass panel, wherein the peripheral edge portion is manually stitched or sewn to the peripheral edge portion of the adjacent carcass panels by threads. These threads also provide a certain amount of friction on the ball surface and allow the user to grip on those portions having threads stitched thereon to throw the baseball or softball having particular trajectory. For example, a player of the baseball or softball may use his fingers to grip on the portion having threads stitched thereon and use the fingers to throw the baseball or softball having a curved trajectory. In fact, the extent to which a player may be able to throw the baseball or softball having various trajectories is considered one of the most important attributes which determine the technique and value of that player.

In light of the above considerations, if the carcass panels of the baseball, softball or the like are adhered onto the ball core, the stitching threads are not provided at the baseball, softball or the like. Therefore, the player will not have any particular portion on the baseball or softball for him or her to grip on. This substantially affects the performance of baseball or softball players. On the other hand, insisting on manual stitching of carcass panels onto the ball core in low productivity and its labor intensive. As labor is becoming an issue, there is a need to seek for alternative production method solving the labor issue. Moreover, when the carcass panels are manually stitched onto the ball core, it is very difficult for the manufacturer to control the quality of the resulting products. This ultimately affects manufacturing cost and the selling price of baseball, softball or the like.

Another problem with stitching of the carcass panels is that when the manufacturer has to manually stitch each of the carcass panels with an adjacent carcass panel, the shape of the carcass panels is severely limited. For example, a shape having sharp edges or irregular contour is not conventionally suitable for baseball or softball because it is extremely difficult for the manufacturer to stitch a carcass panel having a non-conventional shape with an adjacent carcass panel. Poor or inadequate stitching of the carcass panel leads to bizarre or uncontrollable trajectory of the baseball, softball or the like, and make the substantially shortens the life span of the baseball, softball or the like.

SUMMARY OF THE PRESENT INVENTION

The invention is advantageous in that it provides a baseball, softball, or the like, and a manufacturing method thereof, wherein the ball has a plurality of carcass panels attached on a ball core without stitching.

Another advantage of the invention is to a baseball, softball or the like and a manufacturing method thereof, wherein the ball has a plurality of carcass panels attached on a ball core without stitching. However, the baseball, softball or the like also comprises a plurality of stitching threads for allowing a player of the ball to grip thereon so as to make a throw of the baseball, softball or the like having various trajectories.

Another advantage of the invention is to a baseball, softball or the like and a manufacturing method thereof, wherein the ball has a plurality of carcass panels attached on a ball core without stitching, wherein each of the carcass panels is adapted to be cut into a wide variety of shapes for optimal aesthetic or marketing purposes.

Additional advantages and features of the invention will become apparent from the description which follows, and may be realized by means of the instrumentalities and combinations particular point out in the appended claims.

According to the present invention, the foregoing and other objects and advantages are attained by providing a baseball, softball or the like, comprising:

a ball core having a substantially spherical shape; and a plurality of carcass panels each of which is cut into a predetermined shape, and has a main portion, and an edge portion formed along a peripheral edge of the main portion, wherein each of the carcass panels is attached on an outer surface of the ball core without stitching with other the carcass panels.

In accordance with another aspect of the invention, the present invention also provides a method of manufacturing a baseball, softball or the like, comprising the steps of:

(a) providing a ball core having a substantially spherical shape;

(b) providing a plurality of carcass panels each having a main portion, and an edge portion formed along a peripheral edge of the main portion; and (c) attaching each of the carcass panels on an outer surface of the ball core without stitching with other the carcass panels.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

Figure 1:
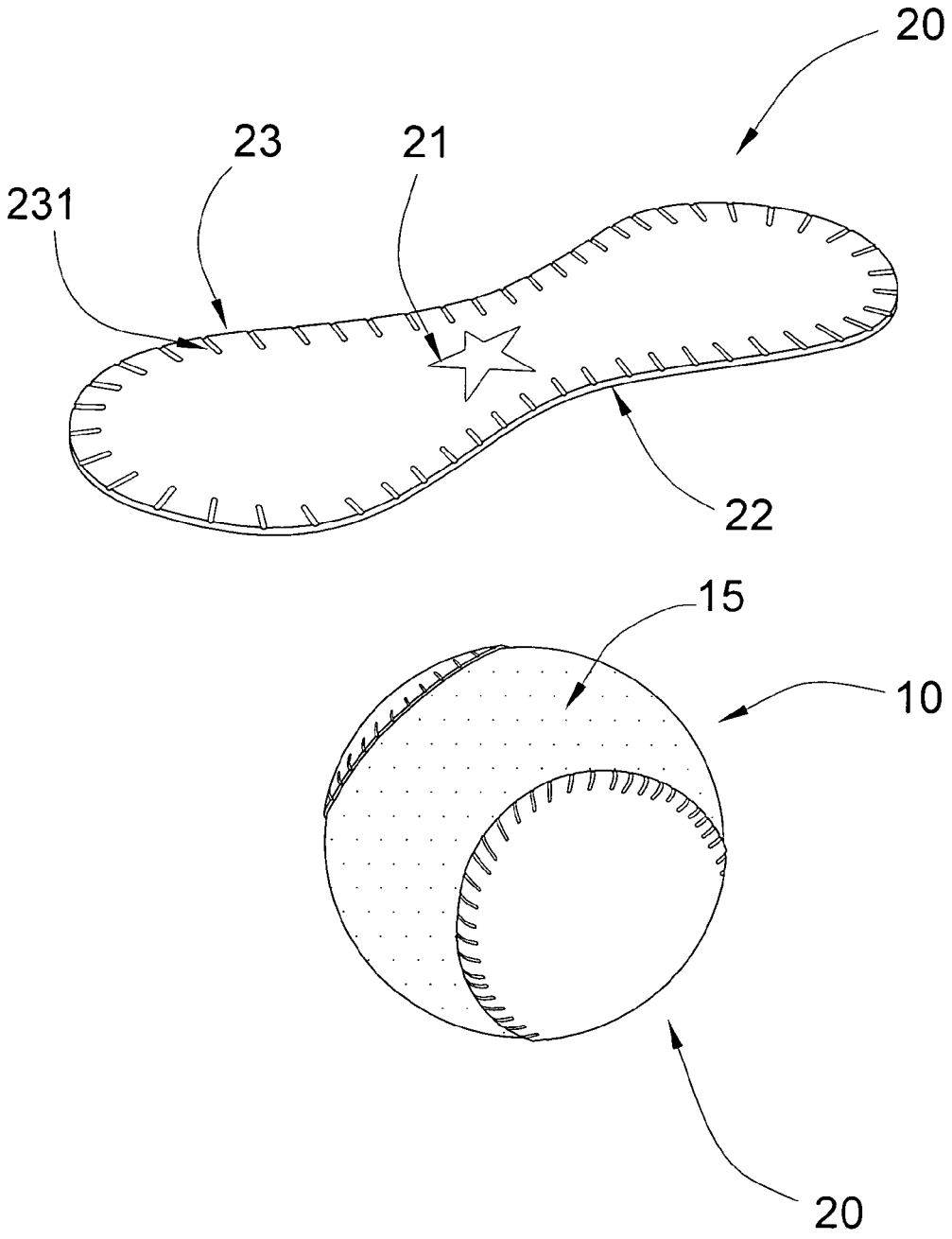
FIG. 1 is a perspective view of a baseball, softball or the like according to a preferred embodiment of the present invention.
Figure 2:
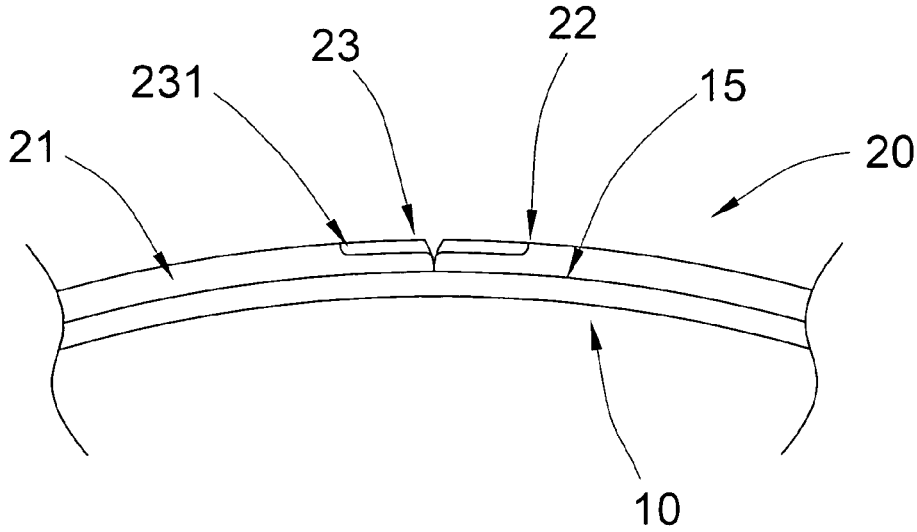
FIG. 2 is a sectional side view of the baseball, softball or the like according to the above preferred embodiment of the present invention.
Figure 5:
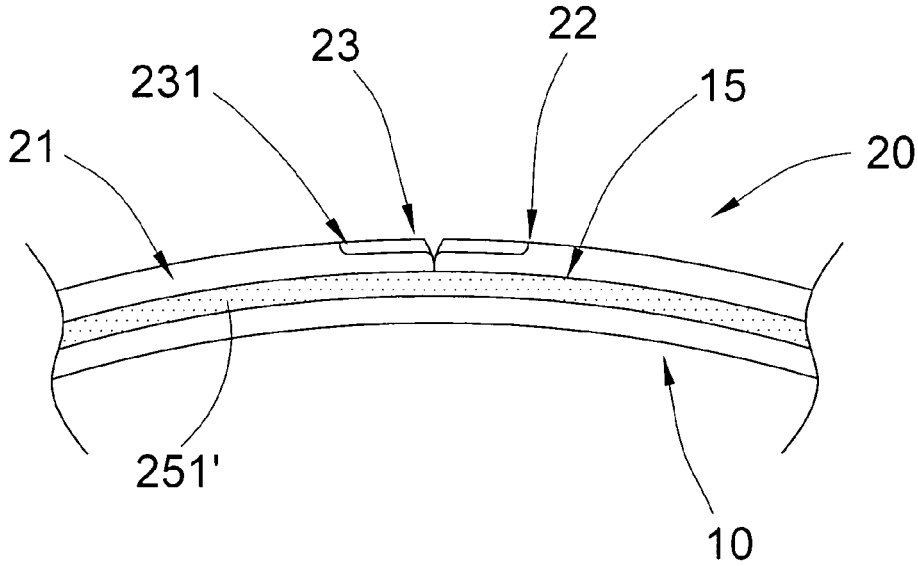
FIG. 5 is a sectional side view of the alternative mode of the baseball, softball or the like according to the above preferred embodiment of the present invention.
Figures 3A, 3B, 3C, 3D:
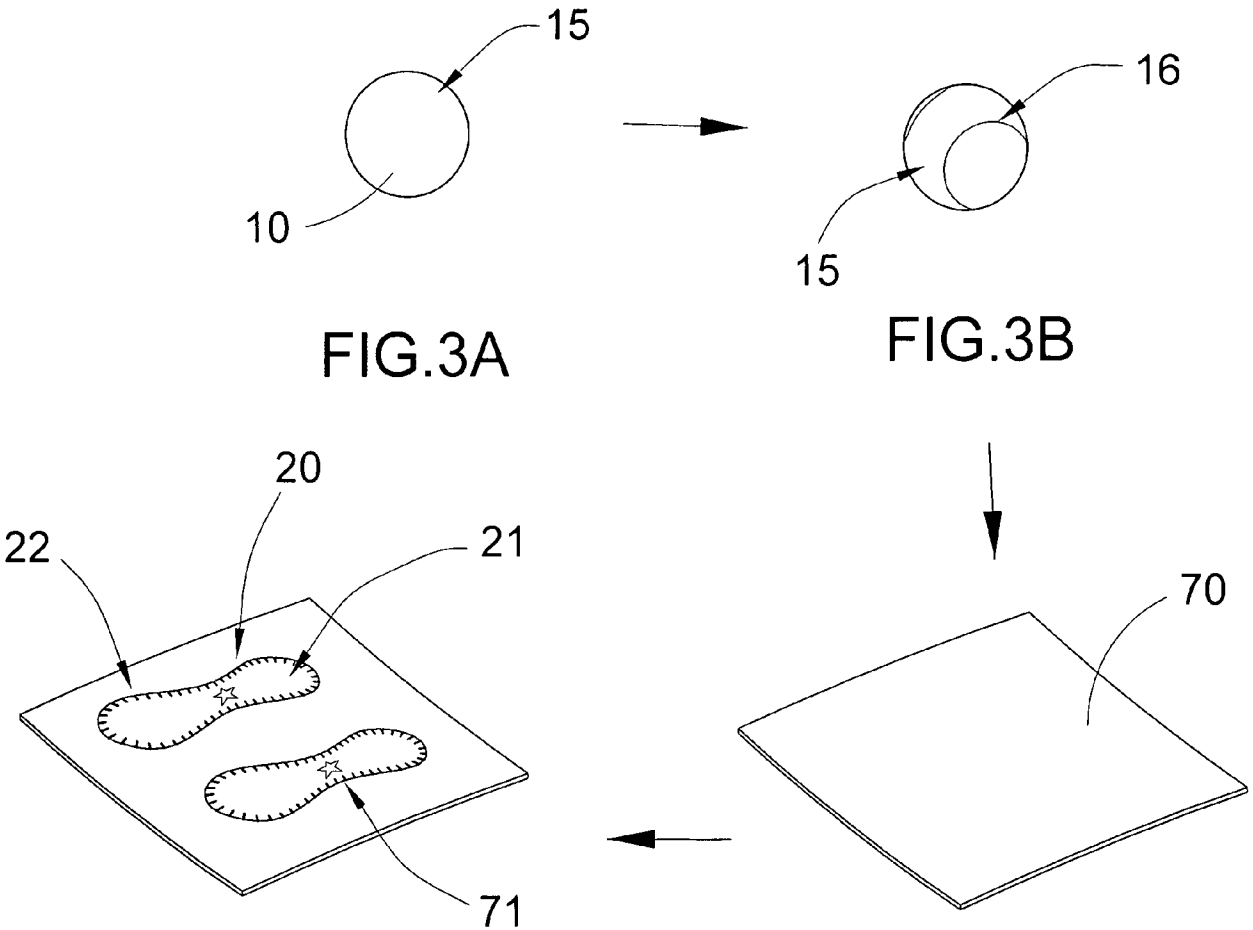
FIG. 3A to FIG. 3M is a method of manufacturing a baseball, softball or the like according to the above preferred embodiment of the present invention.
Figure 3E:
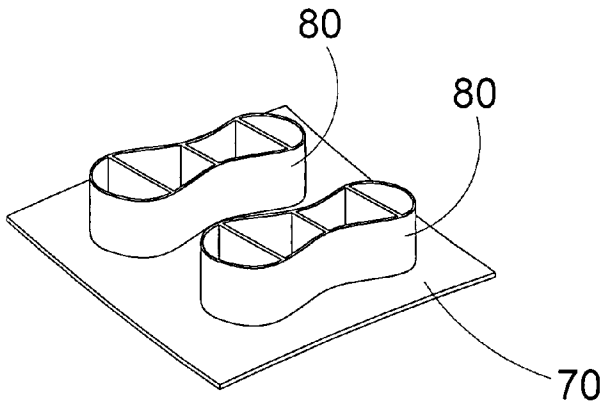
Figure 3F:
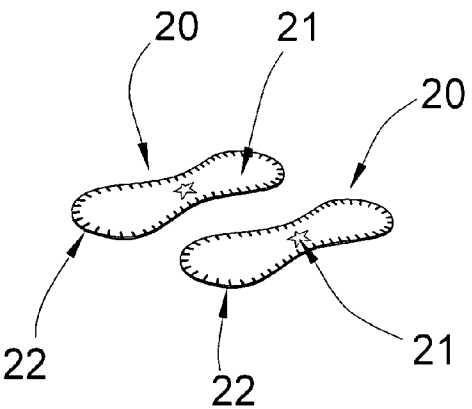
Figure 3G:
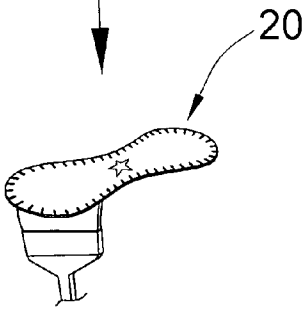
Figure 3H:
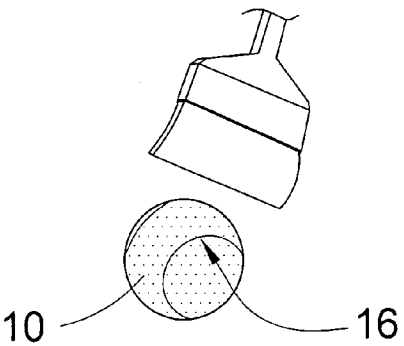
Figures 3I, 3J, 3K, 3L, 3M:
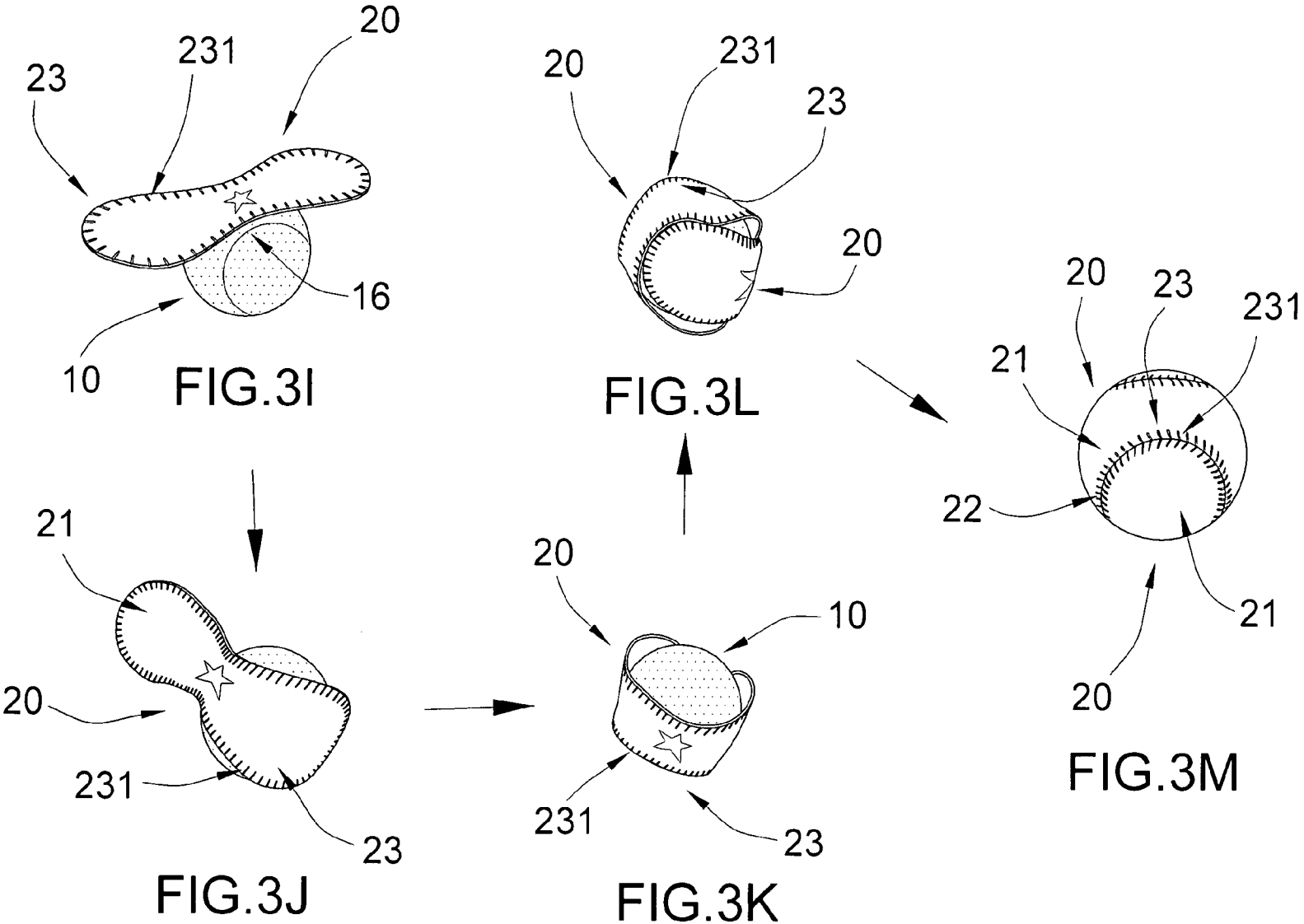
Figure 4:
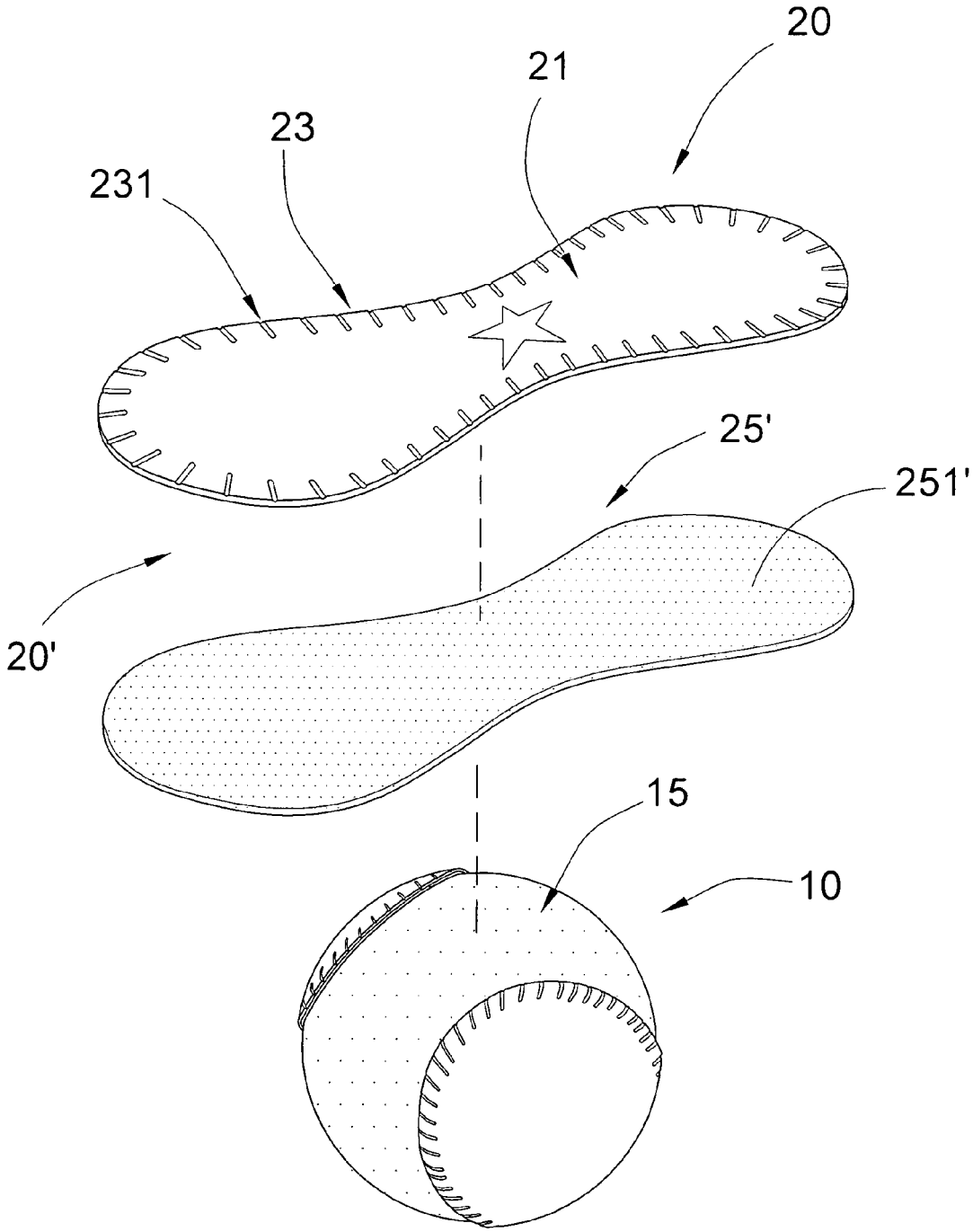
FIG. 4 is a perspective view of an alternative mode of the baseball, softball or the like according to the above preferred embodiment of the present invention.
Figures 6A, 6B, 6C, 6D:
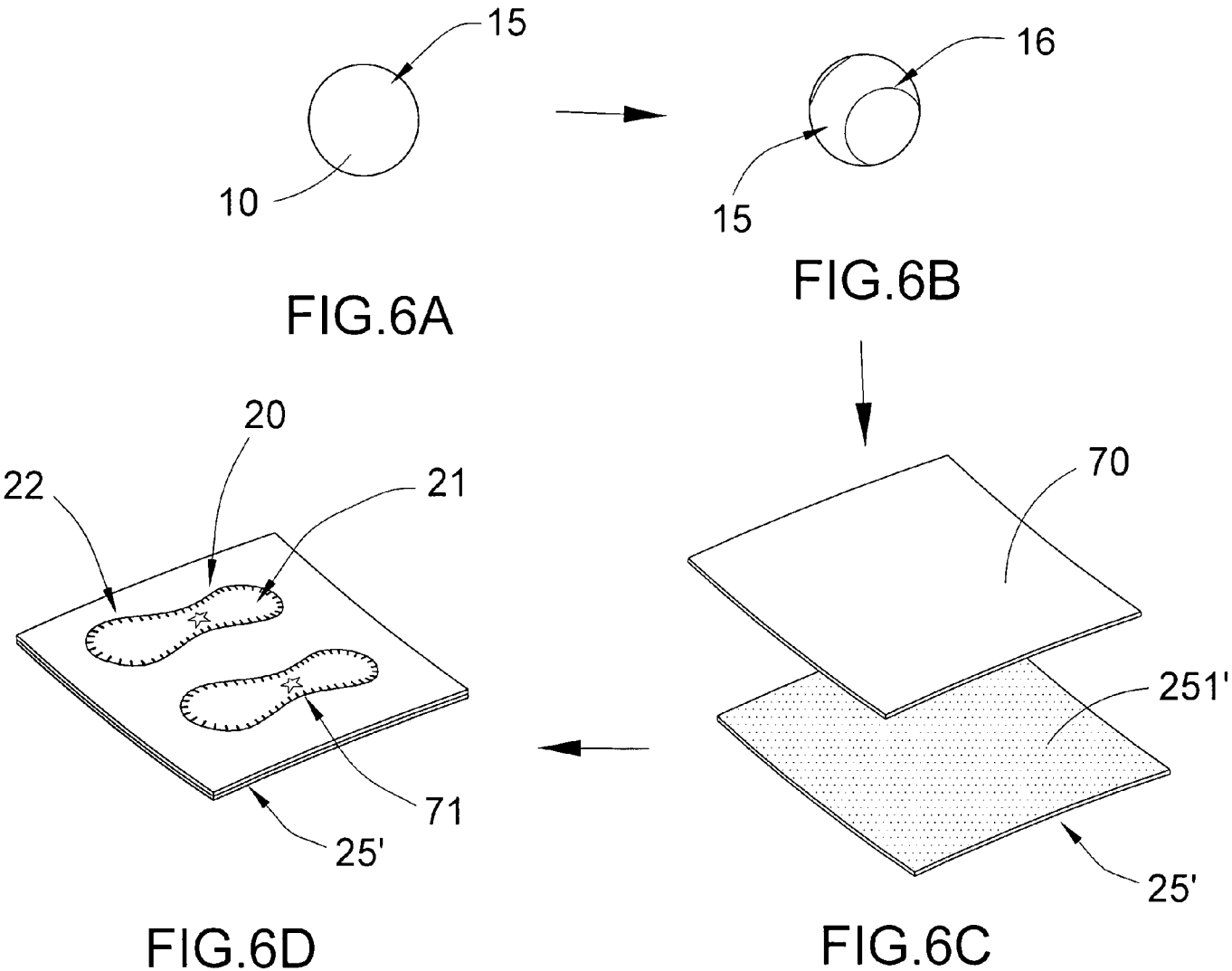
FIG. 6A to FIG. 6M is a method of manufacturing a baseball, softball or the like according to the alternative mode of the above preferred embodiment of the present invention.
Figure 6E:
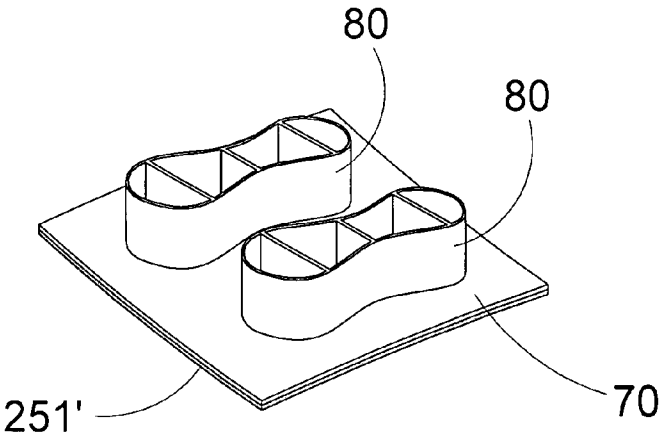
Figure 6F:
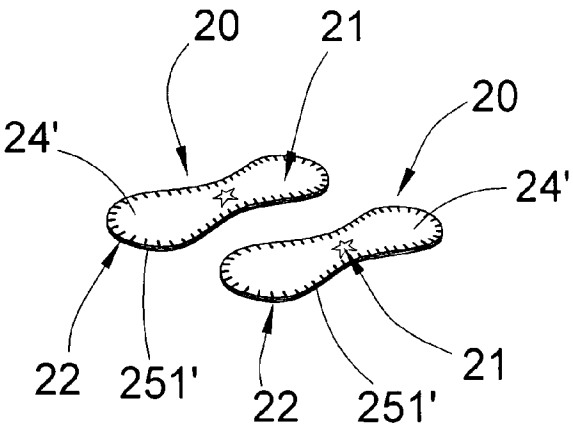
Figure 6G:
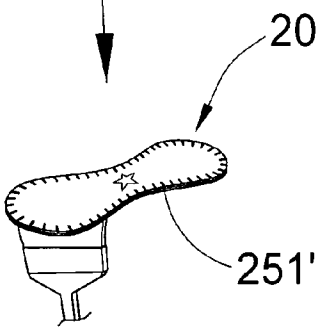
Figure 6H:
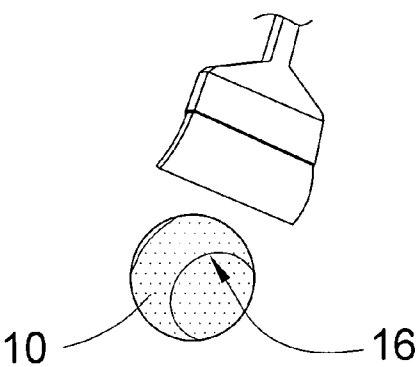
Figures 6I, 6J, 6K, 6L, 6M:
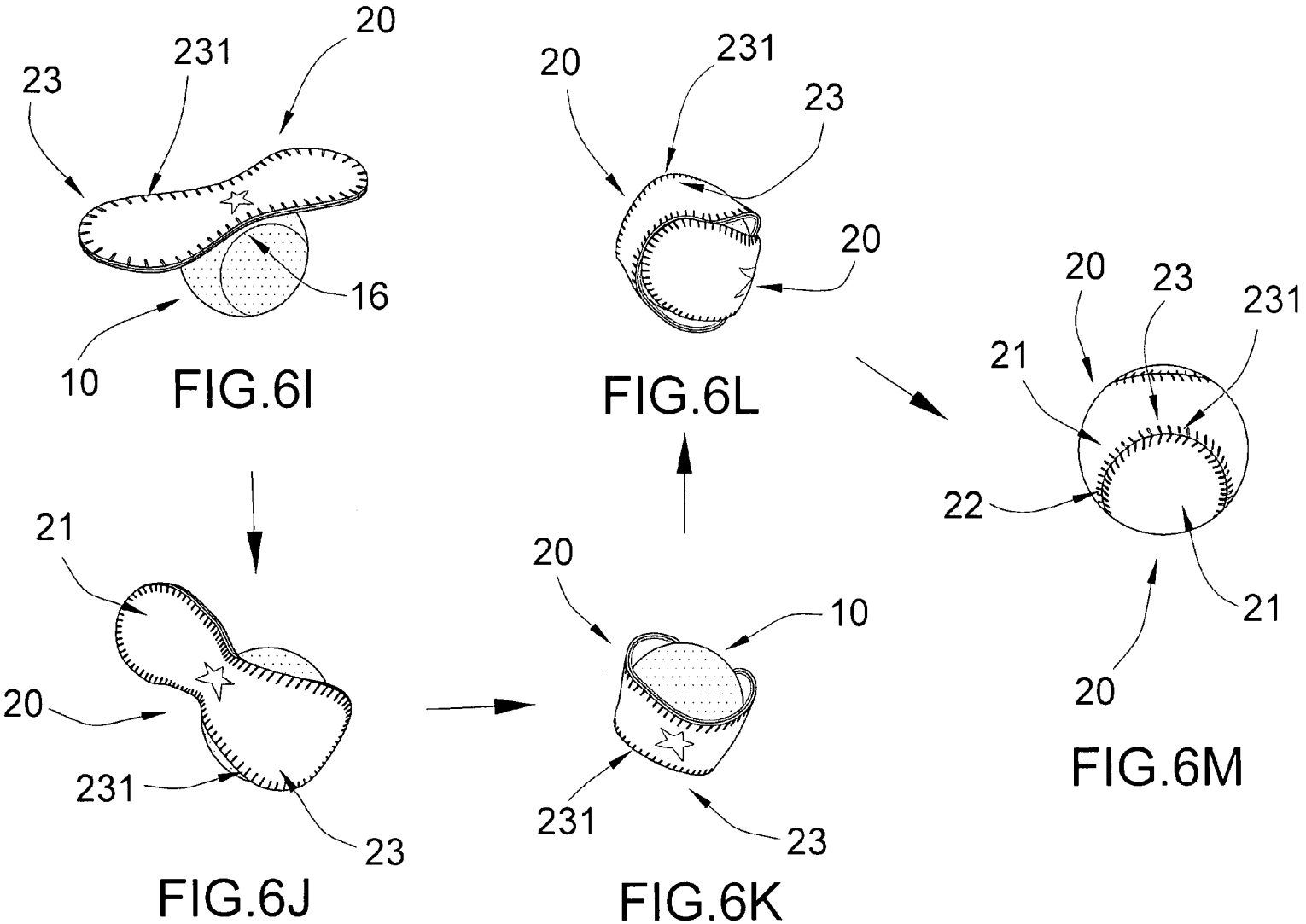

Referring to FIG. 1, FIG. 2 and FIG. 3A to FIG. 3F of the drawings, a baseball, softball or the like according to a preferred embodiment of the present invention is illustrated, in which the baseball, softball or the like, comprises a ball core 10 and a plurality of carcass panels 20. In other words, the ball of the present invention can be embodied as a ball for bat-and-ball sport, such as a baseball, softball or the like.

The ball core 10 is formed in a substantially spherical shape. On the other hand, each of the plurality of carcass panels 20, having a "8" shape, is cut into a predetermined shape, and has a main portion 21, and an edge portion 22 formed along a peripheral edge of the main portion 21, wherein each of the carcass panels 20 is attached on an outer surface 15 of the ball core 10 without stitching with other carcass panels 20 at a position that the carcass panels 20 are attached in an edge-to-edge manner, such that the carcass panels 20 form an outer shell, having the corresponding spherical shape, at the ball core 10 in a thread-less manner. In other words, since the carcass panels 20 are attached in an edge-to-edge manner in a thread-less manner, the ball shell is formed with a seamless structure for the baseball, softball or the like.

Accordingly, two carcass panels 20 are used for attaching to the outer surface 15 of the ball core 10 in a thread-less manner. In other words, the ball, which is embodied as a baseball as an example in the present invention, has no stitching thread formed thereon. It is worth mentioning that the ball core 10 is the core of the baseball, softball or the like and can be formed using rubber and PU with multiple layers of winding threads being wound on top of it by using different threads for cushioning.

According to the preferred embodiment of the present invention, the ball core 10, which is a solid core, is made of rubber material and has a predetermined elasticity for sustaining impact from a baseball or softball bat. Accordingly, the ball core 10 can be composed by a mixture of cork and rubber, urethane mixture core, long fiber kapok or other approved materials. The rubber cork contains multiple layers of windings on top. Other cores such as polyurethane mixed core would not have windings applied.

Each of the carcass panels 20 preferably has a predetermined aesthetic pattern formed on an outer side thereof Moreover, since each of the carcass panels 20 is attached onto the ball core 10 without stitching with an adjacent carcass panel 20, the contour of each of the carcass panels 20 can be designed to constitute any shape without substantially burdening the manufacturing process. In other words, the shape of the carcass panels 20 will not be affected by any manufacturing consideration because it is relatively convenient and easy for the manufacturer to attach a carcass panel 20 onto the ball core 10 irrespective of their shape.

Accordingly, the carcass panels 20 is a cover construction of the ball to form the ball shell of the ball core 10, wherein the carcass panels 20 can be made of synthetic material such as PVC, composites (PU), microfibers composites, rubber, or film material with foam layers.

Moreover, the side edge portion 22 of each of the carcass panels 20 is slanted with respect to the main portion 21 so that a top surface of the side edge portion 22 downwardly and inclinedly extends from the main portion 21 to the outermost edge of the corresponding carcass panel 20 when the carcass panel 20 is attached onto the ball core 10. Therefore, when the carcass panels 20 are attached onto the ball core 10 edge-to-edge, the side edge portions 22 of the two adjacent carcass panels 20 form an indented channel on the outer shell. In other words, the side edge portions 22 of the adjacent carcass panels 20 form the beveled seams for the carcass panels 20 attaching onto the ball core 10 edge-to-edge.

Each of the carcass panels 20 further comprises a friction arrangement 23 formed thereon to provide a zone of frictional surface on which a player may grip for throwing the baseball, softball or the like having a particular trajectory. As shown in FIG. 1 of the drawings, the friction arrangement 23 contains a plurality of elongated indentions 231 spacedly formed along the side edge portion 22 of the corresponding carcass panel 20 for providing a non-smooth outer surface of the corresponding carcass panel 20 so that a user is able to grip on the friction arrangement 23 for throwing the ball having a specifically intended trajectory. Accordingly, the elongated indentions 231 of the friction arrangement 23 are embossed patterns with protruded grooves that simulate the threads and seams of the conventional baseball, softball or the like, wherein the elongated indentions 231 functions as the conventional stitching of the baseball, softball or the like for the player to grip, control, and throw the ball aerodynamically with specifically intended trajectory. It is worth mentioning that the slanted side edge portions 22 of the carcass panels 20 also provide the friction control as the elongated indentions 231 for the player when the player grips at the indented channel of the ball shell.

It is worth mentioning that the friction arrangement 23 can also takes a number of other alternatives such as indentions of different shapes or densities so as to form different friction properties. Each of the , elongated indentions 231 may also contain a predetermined aesthetic appearance such as special colors for easy identification and for better overall aesthetic appearance of the baseball, softball or the like.

According to the preferred embodiment, the elongated indentions 231 are spacedly formed at the side edge portion 22 of the carcass panel 20 to define a plurality of corresponding elongated protrusion, wherein each of the elongated protrusion is formed between every two of the elongated indentions 231. Coloring agent, preferably red color, is applied at each of the elongated indentions 231 to form as the conventional stitching of the baseball, softball or the like. It is worth mentioning that when the carcass panels 20 are attached to the ball core 10, the elongated indentions 231 of one of the carcass panels 20 must be aligned with the elongated indentions 231 of another adjacent carcass panel 20 end-to-end to form stitching-like configuration of the baseball, softball or the like.

It is appreciated that the friction arrangement 23 comprises a plurality of threads pre-stitched at the side edge portion 22 of each of the carcass panels 20 before the carcass panel 20 is attached onto the outer surface 15 of the ball core 10. Therefore, when the carcass panels 20 are attached to the ball core 10, the threads at one of the carcass panels 20 must be aligned with the threads at another adjacent carcass panel 20 to form stitching-like configuration of the baseball, softball or the like. It is worth mentioning that the threads at each of the carcass panels 20 is not used for connecting the two carcass panels 20 but is used for enhancing the friction of the ball for the player to grip and throw the ball.

Each of the carcass panels 20 can be attached onto the outer surface of the ball core 10 through a number of methods. For example, the carcass panels 20 may be attached onto the ball core 10 by a predetermined amount of glue.

The baseball, softball or the like of the present invention can also be conveniently formed as a softball comprising all of the elements described above.

Referring to FIG. 3A to FIG. 3M of the drawings, a method of manufacturing a baseball, softball or the like according to a preferred embodiment of the present invention is illustrated, in which the method comprises the steps of:

(a) providing a ball core 10 with a substantially spherical outer surface 15;

(b) providing a plurality of carcass panels 20 each having a main portion 21, and an edge portion 22 formed along a peripheral edge of the main portion 21; and (c) attaching each of the carcass panels 20 on the outer surface 15 of the ball core 10 without stitching with other carcass panels 20.

The method further comprises a step between step (a) and step (b) of producing a plurality of markings 16 on the outer surface 15 of the ball core 10 which correspond with a corresponding cross sectional shape of the carcass panels 20 to be attached onto the ball core 10 so as to guide accurate attachment of the carcass panels 20 onto the ball core 10. For example, the markings 16 may be in the form of curved lines which indicate the cross sectional shape of a particular carcass panel 20 and the position on which that carcass panel 20 attaches.

Step (b) comprises the steps of:

(b.1) providing a raw material 70 for producing the carcass panels 20;

(b.2) producing a plurality of markings 71 on the raw material 70 which correspond to cross sectional shapes of the carcass panels 20;

(b.3) producing at least one aesthetic pattern, such as texts or logos, on at least one of the cross sections of the carcass panels 20 formed on the raw material so as to constitute an aesthetic pattern on the corresponding outer surface of the carcass panels 20; and (b.4) cutting the raw material 70 along the markings 71 to produce individual carcass panels 20. This cutting procedure may be formed by traditional pressing method using a predetermined cutter 80.

Step (b) further comprises the steps, in between step (b.3) and step (b.4), of producing a slanted side edge portion 22 of each of the carcass panels 20 with respect to a main portion so that a top surface of the side edge portion is downwardly and inclinedly extends from the main portion 21 the outermost edge of the corresponding carcass panel 20, and of producing friction arrangement 23 on the raw material 70 so as to produce enhanced friction at predetermined positions for each or at least one of the carcass panels 20. The slanted side edge portion 22 may be formed by the cutter 80 or by any pressing method. The friction arrangement 23 contains a plurality of elongated indentions 231 spacedly formed along the side edge portion 22 of the corresponding carcass panel 20 for providing a non-smooth outer surface of the corresponding carcass panel 20 so that a user is able to grip on the friction arrangement 23 as a pivot point for throwing the ball having a specifically intended trajectory. Accordingly, a step of aligning the elongated indentions 231 of the carcass panels 20 end-to-end is provided when the carcass panels 20 are attached on the ball core 10 in an edge-to-edge manner.

Step (c) comprises the steps of:

(c.1) applying an adhesive agent onto a bottom surface of each of the carcass panels 20 and the outer surface 16 of the ball core 10; and (c.2) attaching each of the carcass panels 20 onto the ball core 10 by the adhesive agent.

According to the preferred embodiment, heat treatment may be applied to the carcass panels 20 after the carcass panels 20 are attached to the outer surface 15 of the ball core 10 within a ball mold to ensure the carcass panels 20 being secured to form the ball shell to enclose the ball core 10. In other words, the carcass panels 20 are adhered to and integrated with the outer surface 15 of the ball core 10.

Referring to FIG. 4, FIG. 5 and FIG. 6A to FIG. 6M of the drawings, and alternative mode of the baseball, softball or the like according to the preferred embodiment of the present invention is illustrated. The alternative mode is similar to the preferred embodiment, except that in order to enhance the performance of the baseball, softball or the like, the ball further comprises a cushion layer 25' attached between the ball core 10 and the carcass panel 20 for providing a predetermined cushioning effect for the baseball, softball or the like. The attachment between the cushion layer 25' and the carcass panel 20 and between the cushion layer 25' and the ball core 10 can be accomplished by a predetermined adhesive agent, such as specifically designed and manufactured glue. The cushion layer 25' can comprise a single cushioning member 251' attached onto the ball core 10, wherein each of the cushioning members 251' is crafted and designed and cut into a cross sectional shape corresponding to the cross sectional shape of the corresponding carcass panel 20.

Thus, as to the manufacturing method mentioned in the preferred embodiment, in order to provide a cushioning effect to the carcass panels 20, the raw material 70 used in step (a) comprises an outer layer which constitutes the outer carcass layers 24' of the resulting carcass panels 20, and an inner layer which constitutes the cushion layers 25' of the resulting carcass panels 20, as mentioned above. When the raw material 70 is cut into the carcass panels 20, each of the carcass panels 20 comprises the outer carcass layer 24 and the cushion layer 25' comprising the cushioning member 251'. However, it is important to mention that manufacturer of the baseball, softball or the like disclosed in the present invention may manufacture the baseball, softball or the like with or without the cushion layer 25' according to the marketing circumstances.

In other words, the manufacturing method further comprises a step of providing a cushion layer 25' between the ball core 10 and the carcass panels 20. Accordingly, heat treatment may be applied to the carcass panels 20 after the carcass panels 20 are attached to the outer surface 15 of the ball core 10 within a ball mold to ensure the cushion layer 25' of the carcass panels 20 being secured to form the ball shell to enclose the ball core 10. In other words, the carcass panels 20 are adhered to and integrated with the outer surface 15 of the ball core 10.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A ball, comprising:

a ball core having a substantially spherical outer surface; and at least two carcass panels, each of which is cut into a predetermined shape, having a main portion, and an edge portion formed along a peripheral edge of said main portion, wherein each of said carcass panels is attached on said outer surface of said ball core without stitching with other said carcass panels at a position that said carcass panels are attached in an edge-to-edge manner, such that said carcass panels form an outer shell at said ball core in a thread-less manner, wherein said side edge portion of each of said carcass panels is slanted with respect to said main portion so that a top surface of said side edge portion downwardly and inclinedly extends from said main portion to said outermost edge of said corresponding carcass panel, such that when said carcass panels are attached edge-to-edge, said side edge portions of said adjacent carcass panels form an indented channel on said outer shell, wherein each of said carcass panels further comprises a friction arrangement formed along said side edge portion thereof to provide a zone of frictional surface for a player gripping and throwing said ball with a particular trajectory, wherein said friction arrangement comprises a plurality of elongated indentions spacedly formed along said side edge portion of said corresponding carcass panel for providing a non-smooth outer surface of said corresponding carcass panel.

2. The ball, as recited in claim 1, wherein said elongated indentions of said carcass panels are aligned end-to-end when said carcass panels are attached on said ball core in an edge-to-edge manner.

3. The ball, as recited in claim 2, wherein said carcass panels are adhered on said outer surface of said ball core in an edge-to-edge manner.

* * * * *